United States Patent [19]

Wah

[11] 4,098,100

[45] Jul. 4, 1978

[54] LAMINATED PADLOCK

[76] Inventor: Man Wah, 2664 Kowloon Central Post Office, Hong Kong, Hong Kong

[21] Appl. No.: 789,011

[22] Filed: Apr. 20, 1977

[51] Int. Cl.[2] ..... E05B 67/22

[52] U.S. Cl. ..... 70/38 A; 70/379 R

[58] Field of Search ..... 70/38 A, 38 B, 38 C, 70/38 R, 49, 379 R, 380

[56] References Cited

U.S. PATENT DOCUMENTS

| | | | |
|---|---|---|---|
| 1,660,903 | 2/1928 | Adamson | 70/38 A |
| 2,691,288 | 10/1954 | Childs | 70/38 A |
| 3,475,930 | 11/1969 | Foote | 70/38 A |
| 3,605,458 | 9/1971 | Best | 70/49 |
| 3,882,699 | 5/1975 | Fleck | 70/38 A |
| 3,979,931 | 9/1976 | Man | 70/38 A |

*Primary Examiner*—Robert L. Wolfe

*Attorney, Agent, or Firm*—Edmond T. Patnaude

[57] ABSTRACT

A laminated padlock includes a pair of coplanar locking plates slidable into locking positions in engagement with the two legs of a J-shaped shackle and a separate coupling member positioned between the lock barrel and the locking plates to prevent picking of the lock by means of a tool inserted through the key slot in the lock cylinder.

3 Claims, 4 Drawing Figures

LAMINATED PADLOCK

The present invention relates in general to padlocks having shackles which are double locked, and it relates in particular to a new and improved laminated padlock which is less expensive to manufacture and more difficult to pick than those padlocks now on the market.

BACKGROUND OF THE INVENTION

Padlocks in which a pair of locking members are slideably mounted for reciprocable movement into and out of notches in the heel and toe portions of the shackle are well known in the art. U.S. Pat. No. 3,475,930 describes such a padlock wherein the locking members are plates or slides respectively disposed in two different planes. U.S. Pat. No. 3,979,931 describes a padlock of this general type wherein the locking plates are respectively slideable in the same plane. In order to improve the safety factor of these latter type padlocks it would be desirable to incorporate means within the lock to prevent the intrusion of burglar tools into the lock mechanism physically to press the locking plates out of the locking positions. In addition, it would be desirable to reduce the manufacturing cost of the padlock. The present invention enables the manufacture of a laminated padlock at a reduced cost while enhancing the safety factor of the padlock by making it more difficult to pick.

SUMMARY OF THE INVENTION

Briefly, there is provided in accordance with the present invention a novel mechanism for retracting a pair of co-planar slideable locking plates from locking engagement with the shackle in response to rotation of the key operated lock barrel. A safety rotator is interposed between the lock barrel and the slide plates and prevents the insertion of a burglar tool through the key slot into engagement with the slide plates.

The novel padlock design of the present invention reduces the manufacturing cost of the padlock by substantially reducing the size of the lock barrel, which is normally made of brass, and by facilitating the initial assembly of the padlock.

GENERAL DESCRIPTION OF THE DRAWING

Further objects and advantages and a better understanding of the present invention can be had by reference to the following detailed description, wherein.

DETAILED DESCRIPTION OF THE INVENTION

Figure 1:
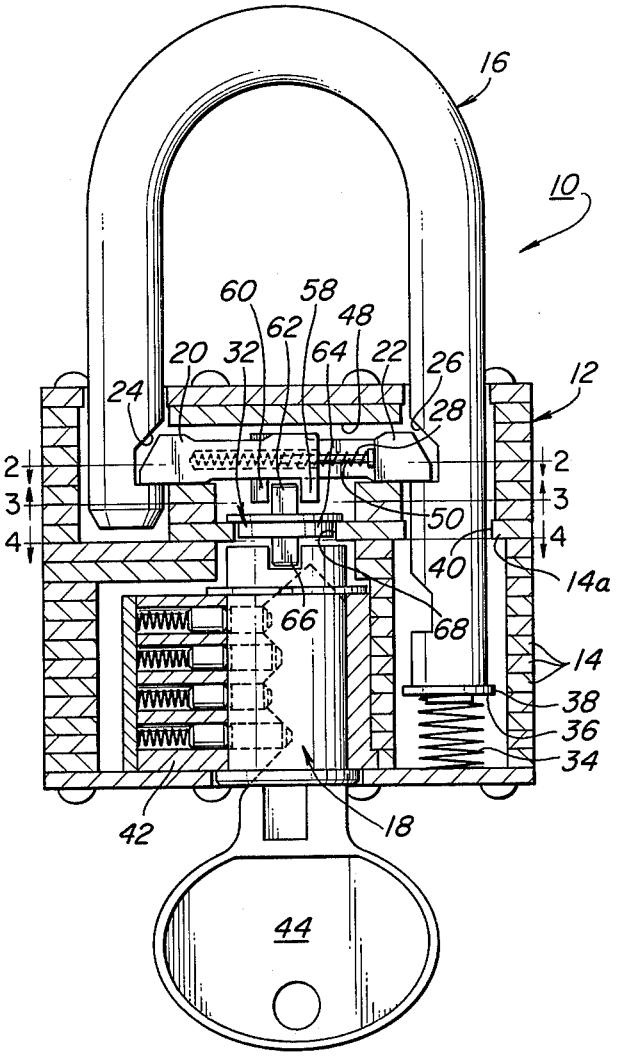
FIG. 1 is an elevational view, partly in cross-section of a padlock embodying the present invention.
Figure 2:
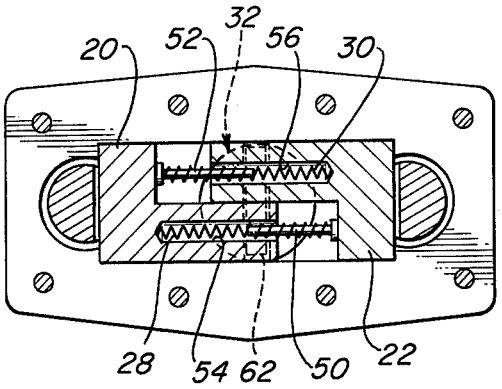
FIG. 2 is a cross-sectional view taken along the line 2—2 of FIG. 1.

As shown in FIG. 1, a padlock 10 comprises a body 12 made up of a plurality of laminated body plates 14, a shackle 16, a key operated lock barrel or cylinder 18 and a locking mechanism including a pair of co-planar, slideable locking plates 20 and 22. The plates 20 and 22 are respectively biased by means of a pair of coil springs 28 and 30 in outward directions into the extended locking positions wherein the outer ends thereof are within a pair of respective notches 24 and 26 in the legs of the shackle 16 (FIG. 2). As more fully described hereinafter, a safety rotator 32 couples the lock barrel 18 to the locking plates 20 and 22 whereby rotation of the lock cylinder 18 retracts the slide plates against the outward forces of the springs 28 and 30 to retract the locking plates from the notches 24 and 26 to release the shackle 16.

In order to urge the shackle into the open position after it is released by the locking plates, a coil spring 35 is compressed between the heel end 36 of the shackle and the lowermost one of the body plates 14. Complete removal of the shackle 16 from the body 12 is prevented by means of the external annular flange 38 at the heel end of the shackle and the intermediate body plate identified as **14*a*. As shown, the body plate 14*a* has a circular opening 40 receiving the heel end of the shackle. The hole 40 has a diameter less than that of the flange 38 but greater than that of the leg or shank portion of the shackle 16**.

The lock barrel 18 is mounted in a lock body 42 located in a suitable cavity in the body 12. The lock body 42 is held in place in the body of the padlock by the lowermost one of the body plates 14. The lock body 42 is thus fixedly positioned in the body 12 and supports a plurality of conventional tumbler pins which are moved radially outward when a key 44 is inserted into the key slot 45 in the lock barrel 18. When the proper key is placed in the key slot 45 the tumbler pins are so positioned as to permit rotation of the lock barrel 18 within the lock body 42.

Figure 4:
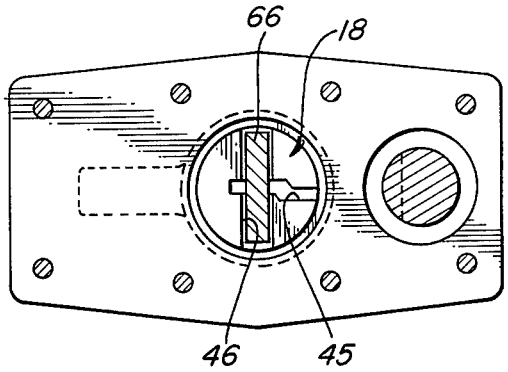
FIG. 4 is a cross-sectional view taken along the line 4—4 of FIG. 1.

Referring to FIG. 4 it may be seen that the key slot 45 extends completely through the inner or upper end of the barrel 18 and a diametric slot 46 is provided in the end of the barrel. The slots 45 and 46 extend in mutually orthogonal directions. As is well known in the art, the barrel 18 is preferably machined from brass stock and the slot 46 is preferably provided by either a sawing or milling operation.

Figure 3:
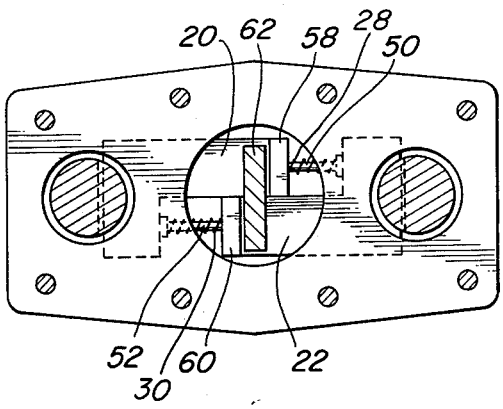
FIG. 3 is a cross-sectional view taken along the line 3—3 of FIG. 1.

The locking plates 20 and 22 are each generally L-shaped and are slideably disposed in a cavity 48 in the lock body. The coil springs 28 and 30 are respectively mounted on pins 50 and 52 and extend into blind holes 54 and 56 in the locking plates 20 and 22. At the inner end of the locking plate 20 there is provided a downwardly extending integral arm 58, and a similar arm 60 is provided at the inner end of the locking plate 22. As best shown in FIGS. 1 and 3 the arms 58 and 60 are mutually offset by a distance slightly greater than the width of a flange 62 on the safety rotor 32. It may thus be seen that axial rotation of the safety rotator 32 will by virtue of the flange 62 simultaneously retract the ends of the locking plates 20 and 22 from the notches 24 and 26 in the shackle 16.

The safety rotator 32 is preferably made of a suitable hard and durable metal alloy and includes a disc-like central body portion 64 and a second diametric flange 66 which is parallel with the flange 62 and extends downwardly into the slot 46. The safety rotator 32 is journalled in a circular opening 68 in the intermediate body plate **14*a*. An external annular flange at the top of the body portion 64 loosely rests on the upper surface of the body plate 14*a* to prevent binding of the safety rotator between the lock cylinder and the locking plates. The circular body portion 66 of the safety rotator 32 completely overlies the inner end of the key slot 45 in the lock barrel whereby to prevent the insertion of a wire-like tool (not shown) through the slot 45 into engagement with the locking plates 20 and 22. Moreover, the dimensions of the safety rotator are such as to prevent the safety rotator from being pushed upwardly out of and thus free from the slot 46**.

OPERATION

When a proper key 44 is inserted into the slot 45 in the lock barrel 18, the tumbler pins are moved radially outwardly to allow the barrel 18 to be rotated. Rotation of the barrel 18 rotates the safety rotator 32 and as the safety rotator 32 rotates in a clockwise direction as viewed from the bottom of FIG. 1, one side of the flange 62 presses on the arm 58 to move the locking plate 20 to the right and the other side of the flange 62 simultaneously presses on the arm 60 to move the locking plate 22 to the left. The shackle 16 is thus released when the rotator has been rotated through a sufficient angle to completely withdraw the locking plates 20 and 22 from the notches in the two legs of the shackle 16.

When the shackle 16 is pushed into the body with the lock barrel returned to its initial locked position, the springs 28 and 30 urge the locking plates outwardly into the notches in the shackle 16 to provide automatic latching of the shackle in the body of the padlock.

The use of the safety rotator 32 thus provides several important advantages over the prior art. One, it prevents the direct actuation of the locking plates by means of a burglar tool inserted through the key slot; two, it reduces the amount of the relatively expensive brass which must be used in the lock cylinder; three, the locking mechanism comprising the locking plates and the safety rotator are held in assembled relationship by the plate 14*a* prior to assembly of the key operated lock 18, 42; and four, it permits the cutting of the key slot 45 completely through the end of the lock cylinder. This latter operation is substantially less costly than is the milling of irregular shapes at the inner end of the lock cylinder as has been previously done in many prior art lock constructions.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A padlock comprising in combination a plurality of superimposed flat plates secured together to provide a laminated body, a shackle having a pair of spaced, parallel legs, said laminated body having first and second openings respectively receiving said legs, a key operated lock barrel mounted in one end of said laminated body for selective rotation, said lock barrel having a transverse slot at the inner end, a safety rotator rotatably mounted in said laminated body, said safety rotator having a cylindrical body portion provided with an annular flange extending beyond the perimeter thereof at one end, an intermediate one of said flat plates having a circular opening rotatably receiving said cylindrical body portion with said annular flange resting on one side of said intermediate one of said flat plates, said safety rotator having a first portion extending from one end into said slot, said safety rotator having a cam portion at the other end, first and second locking plates mounted in said laminated body for reciprocal movement in a plane lying perpendicular to the axis of rotation of said safety rotator, first and second cam follower surfaces respectively provided on said plates for operative engagement by said cam portion to move said locking plates simultaneously away from said legs, a plurality of notches respectively provided in said legs, said notches being aligned with said locking plates when said shackle is in a locked position, and spring means interposed in compressed relationship between said locking plates for resiliently biasing the ends of said locking plates into said notches to retain said shackle in the locked position until said key operated locking barrel is rotated to rotate said safety rotator to move said locking plates out of said notches.

2. A padlock according to claim 1 wherein said annular flange is disposed at said other end of said cylindrical body portion, whereby said intermediate one of said flat plates retains said safety rotator in said laminated body prior to the assembly of said lock barrel therein.

3. A padlock according to claim 2 wherein said intermediate one of said lock plates is adjacent to and partially overlies the inner end of said lock barrel.

* * * * *